US006066012A

United States Patent [19]

Nagle

[11] Patent Number: 6,066,012

[45] Date of Patent: May 23, 2000

[54] PROPULSION SYSTEM FOR A MARINE VESSEL

[76] Inventor: Thomas J Nagle, 89 Wedgewood Dr., Coram, N.Y. 11727

[21] Appl. No.: 09/236,200

[22] Filed: Jan. 23, 1999

[51] Int. Cl.[7] ..... B63H 20/14

[52] U.S. Cl. ..... 440/75; 440/80; 440/83

[58] Field of Search ..... 440/75, 79, 80, 440/83

[56] References Cited

U.S. PATENT DOCUMENTS

| | | | |
|---|---|---|---|
| 3,112,728 | 12/1963 | Krause | 440/75 |
| 3,128,742 | 4/1964 | Cameron | 440/75 |
| 4,428,734 | 1/1984 | Ludlow | 440/75 |

*Primary Examiner*—Stephen Avila

*Attorney, Agent, or Firm*—Michael I. Kroll

[57] ABSTRACT

A system for propelling a marine vessel having a hull. The propulsion system including a first propeller assembly positioned to extend from the hull and along starboard side of the vessel, the first propeller assembly including a propeller positioned outside the hull and a second propeller assembly positioned to extend from the hull and along a port side of the vessel, the second propeller assembly including a propeller positioned outside the hull. An engine is mounted within the hull and connected to both the first and second propeller assemblies for imparting rotation to both the first and second propellers. The engine is connected to the first propeller assembly by a first rotating unit connected between the engine and first propeller assembly for rotating the first propeller. The engine is connected to the second propeller assembly by a second rotating unit connected between the engine and second propeller assembly for rotating the second propeller.

7 Claims, 4 Drawing Sheets

PROPULSION SYSTEM FOR A MARINE VESSEL

BACKGROUND OF THE INVENTION

1. Field of the Invention

The present invention relates generally to nautical craft drive units, and more specifically, to a propulsion system able to increase the drive power of a marine vessel utilizing two propellers powered by a single motor.

2. Description of the Prior Art

Numerous nautical craft drive units have been provided in prior art. For example, U.S. Pat. Nos. 3,881,444 to Sigg; 4,036,164 Kowach et al. and 4,311,472 to Hiersig all are illustrative of such prior art. While these units may be suitable for the particular purpose to which they address, they would not be as suitable for the purposes of the present invention as heretofore described.

U.S. Pat. No. 3,881,444

Inventor: Hans Sigg

MARINE DRIVE GEARING

Drive gear transmission for a pair of marine propellers comprises in combination, a first propeller shaft for one of the propellers and a second propeller shaft for the other one of the propellers. A respective drive means is for rotating the first and second propeller shafts. Respective trains of drive gears are connected to and rotated by the drive means. The gear trains are connected to the shafts to transmit the drives of the respective drive means to the first and second propeller shafts. A mechanical interconnection means couples the first and second propeller shafts together, so that the propeller shafts rotate in synchronism. The interconnections means comprises a first gear interconnection and a second gear interconnection arranged in parallel and intermeshed engagement. A preloading means is associated with at least one of the first and second gear interconnections for applying opposite preloading torques to the first and second gear interconnections. Each drive gear train comprises an intermediate shaft. The gearing of the train connects the intermediate shaft to the drive input means and to the propeller shaft. The respective intermediate shafts have the interconnection means secured to them. The first and second gear interconnections each comprises a pair of gear wheels.

U.S. Pat. No. 4,036,164

Inventor: Ronald A. Kowach and William I. Rowen

TWIN CONTROLLABLE PITCH PROPELLERS OPERATED FROM SINGLE PRIME MOVER

A control system for a variable pitch twin propeller propulsion system of a vessel includes a port propeller and a starboard propeller. Both of the propellers are driven through a transmission by a single prime move operating at a predetermined substantially fixed rotational speed. The port and starboard propellers are to present a substantially fixed load to the prime mover in a first mode. The control systems comprises an isochronous governor for generating a signal representative of a deviation from the predetermined system fixed rotational speed. A port manual control means is for generating a signal representative of a setting of the desired pitch for the port propeller. A starboard manual control means is for generating a signal representative of a setting of the desired pitch for the starboard propeller. A port servo means is for setting the pitch of the port propeller. The port servo means is responsive to a first signal for setting the pitch of the port propeller. The starboard servo means is responsive to a second signal for setting the pitch of the starboard propeller. A port multiplier is for applying a first signal to the port servo. A starboard multiplier is for applying a second signal to the starboard servo. Each multiplier has a first input, a second input and an output. A means is for connecting the signal from the isochronous governor to the first input of the port and starboard multipliers. A means is for connecting the signal from the isochronous governor to the first input of the port and starboard multipliers. A means is for connecting the signal from the port manual control means to the second input of the port multiplier. A means is for connecting the signal from the starboard manual control means to the second input of the starboard multiplier. A means is for connecting the output of the port multiplier to the port servo means. A means is for connecting the output of the starboard multiplier to the starboard servo means.

U.S. Pat. No. 4,311,472

Inventors: Heinz M. Hiersig and Hans Steinberg

MARINE PROPULSION SYSTEM FOR TWO PROPELLERS

A drive and propulsion system for ships, includes first and second drive engines, first and second propeller-shaft means for connection to first and second propellers respectively and a gear and transmission system, comprising a first and second reducing gear, respectively for connection to the first and second engines. The reducing gears each include an intermediate shaft means connected to the respective engine for being driven by the respective engine. Each reducing gear further includes pinion means on the intermediate shaft means. The pinion means pertains to a reducing stage for connecting the intermediate shaft means to an output shaft. The output shafts of the first and second reducing gear are respectively connected to the first and second propeller shaft means for causing the propeller shafts to rotate in opposite directions. An override clutch means is for respectively connecting the first and second engines to the intermediate shaft means. Each intermediate shaft means can be drivingly separated from the respective engine. First and second independently operable clutch means respectively connect to the intermediate shaft means. The first and second clutch means further connects to first and second gears. The respective clutch means when operated connected the respective latter gears to the respective intermediate shaft means. A gear means is for directionally interconnecting the first and second gears. For the operated first and second clutch means, each intermediate shaft means can drive the respective other one. The two propeller shafts rotate in opposite directions. While for the released clutches, the gears and gear means are disconnected from either of the intermediate shaft means.

SUMMARY OF THE PRESENT INVENTION

The present invention relates generally to nautical craft drive units, and more specifically, to a propulsion system able to increase the drive power of a marine vessel utilizing two propellers powered by a single motor.

A primary object of the present invention is to provide a propulsion system for a marine vessel that will overcome the shortcomings of the prior art devices.

Another object of the present invention is to provide a propulsion system for a marine vessel, which includes a single engine mounted in the marine vessel for simultaneously driving two propeller assemblies thereby via a primary gear box driven by the single engine connected to two subordinate gear boxes coupled to two propeller assemblies.

An additional object of the present invention is to provide a propulsion system for a marine vessel that will eliminate the need for a second engine, thereby reducing the weight of the vessel whereby the vessel becomes more fuel efficient providing a tremendous saving to the owner of the marine vessel.

Another object of the present invention is to provide a propulsion system for a marine vessel that is simple and easy to use.

A further object of the present invention is to provide a propulsion system for a marine vessel that is economical in cost to manufacture.

Further objects of the present invention will appear as the description proceeds.

A system for propelling a marine vessel having a hull is disclosed by the present invention. The propulsion system including a first propeller assembly positioned to extend from the hull and along starboard side of the vessel, the first propeller assembly including a propeller positioned outside the hull and a second propeller assembly positioned to extend from the hull and along a port side of the vessel, the second propeller assembly including a propeller positioned outside the hull. An engine is mounted within the hull and connected to both the first and second propeller assemblies for imparting rotation to both the first and second propellers. The engine is connected to the first propeller assembly by a first rotating unit connected between the engine and first propeller assembly for rotating the first propeller. The engine is connected to the second propeller assembly by a second rotating unit connected between the engine and second propeller assembly for rotating the second propeller.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
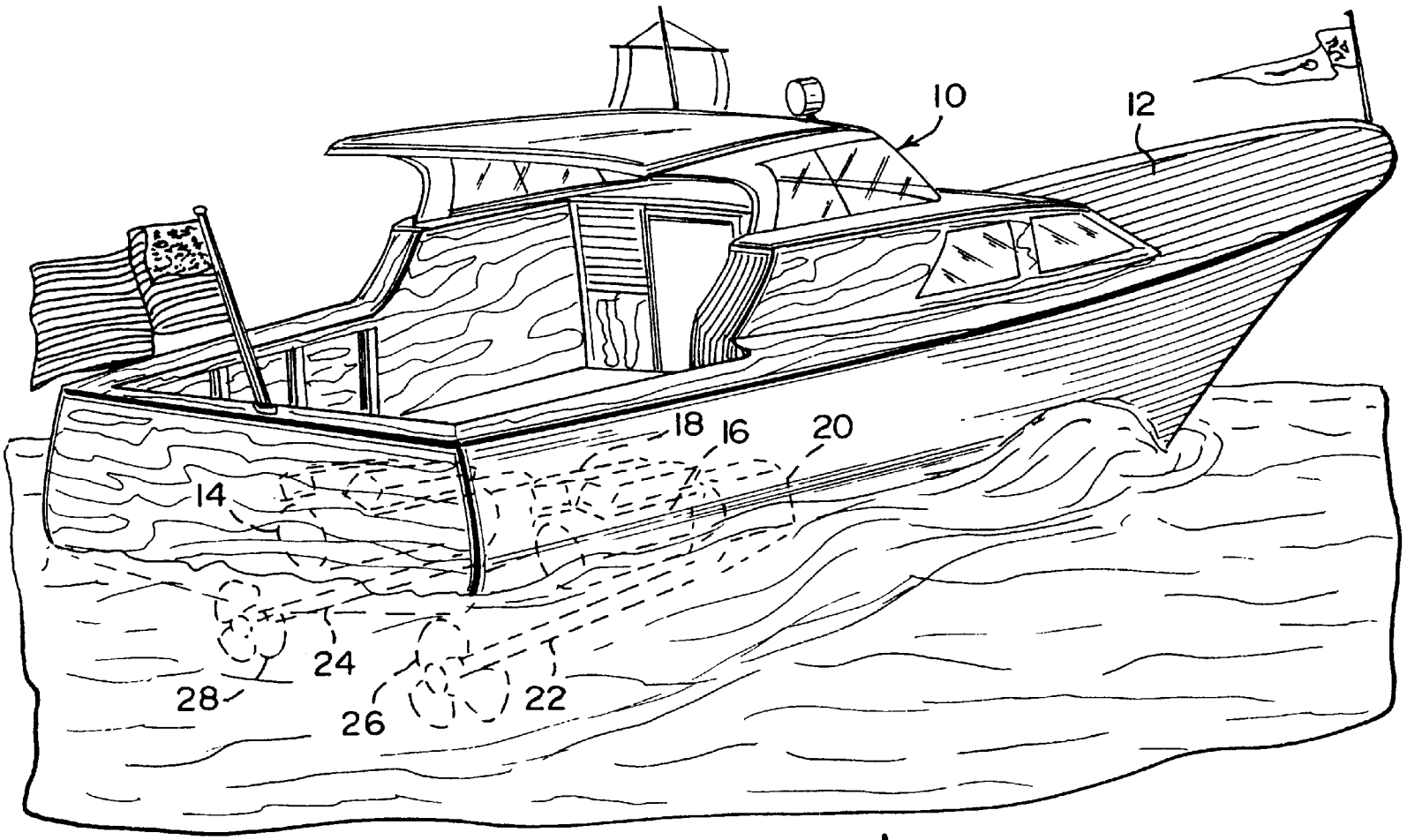
FIG. 1 (PRIOR ART)
FIG. 1 is a perspective view of a prior art nautical craft traveling in a body of water, the propulsion system of the craft shown in dotted lines.

Turning now descriptively to the drawings, in which similar reference characters denote similar elements throughout the several views, the Figures illustrate the propulsion system for a marine vessel of the present invention. With regard to the reference numerals used, the following numbering is used throughout the various drawing figures.

10 nautical craft

12 hull of nautical craft

14 first engine within hull

16 second engine within hull

18 first transmission unit within hull

20 second transmission unit within hull

22 first propeller shaft connected to first transmission unit

24 second propeller shaft connected to second transmission unit

26 first propeller on first propeller shaft

28 second propeller on second propeller shaft

30 propulsion system for a marine vessel of the present invention

32 marine vessel

34 hull of marine vessel

36 first propeller assembly within hull

38 second propeller assembly within hull

40 single engine within hull

42 device for connecting first and second propeller assemblies to engine

44 first existing transmission unit of first propeller assembly

46 first propeller shaft of first propeller assembly

48 first propeller of first propeller assembly

50 second existing transmission unit of second propeller assembly

52 second propeller shaft of second propeller assembly

54 second propeller of second propeller assembly

56 drive shaft of driving apparatus or 64

60 flywheel of single engine

62 bearing in drive shaft

64 primary gearbox of driving apparatus

66 first subordinate gearbox of driving apparatus

68 second subordinate gearbox of driving apparatus

70 first coupling structure of driving apparatus

72 second coupling structure of driving apparatus

74 casing of primary gearbox

76 first bearing in first side wall

78 second bearing in second side wall

80 first side wall of casing of primary gearbox

82 second side wall of casing of primary gearbox

84 primary driven shaft on first and second bearings

86 first bevel gear on drive shaft

88 second bevel gear on primary driven shaft

90 casing of first subordinate gearbox

92 first bearing in first end wall of casing of first subordinate gearbox

94 second bearing in second end wall of first end wall of casing of first subordinate gearbox

96 third bearing in side wall of second end wall of first subordinate gearbox

98 first end wall of casing of first subordinate gearbox

100 second end wall of first end wall of casing of first subordinate gearbox

102 side wall of casing of first subordinate gearbox

204 first subordinate driven shaft on first and second bearings

106 second subordinate driven shaft on third bearing

108 first bevel gear on first subordinate driven shaft on first and second bearings

110 second bevel gear on second subordinate driven shaft on third bearing

112 casing of second subordinate gearbox of driving apparatus

114 first bearing in end wall of casing of second subordinate gearbox of a driving apparatus

116 second bearing in first side wall of casing of second subordinate gearbox of driving apparatus

118 third bearing n second side wall ofcasing of second subordinate gearbox of driving apparatus

120 end wall of casing of second subordinate gearbox of driving apparatus

122 first side wall of casing of second subordinate gearbox of driving apparatus

124 second side wall of casing of second subordinate gearbox of driving apparatus

126 first subordinate driven shaft on first bearing

128 second subordinate driven shaft on second and third bearings

130 first bevel gear on first subordinate driven shaft

132 second bevel gear on second subordinate driven shaft

134 first ball and socket universal joint of first coupling structure of driving apparatus

136 second ball and socket universal joint of first coupling structure of driving apparatus

138 first cylindrical shank of first coupling structure of driving apparatus

140 third ball and socket universal joint of second coupling structure of driving apparatus

142 fourth ball and socket universal joint of second coupling structure of driving apparatus

144 second cylindrical shank of second coupling structure of driving apparatus

DETAILED DESCRIPTION OF THE PREFERRED EMBODIMENT

Figure 3:
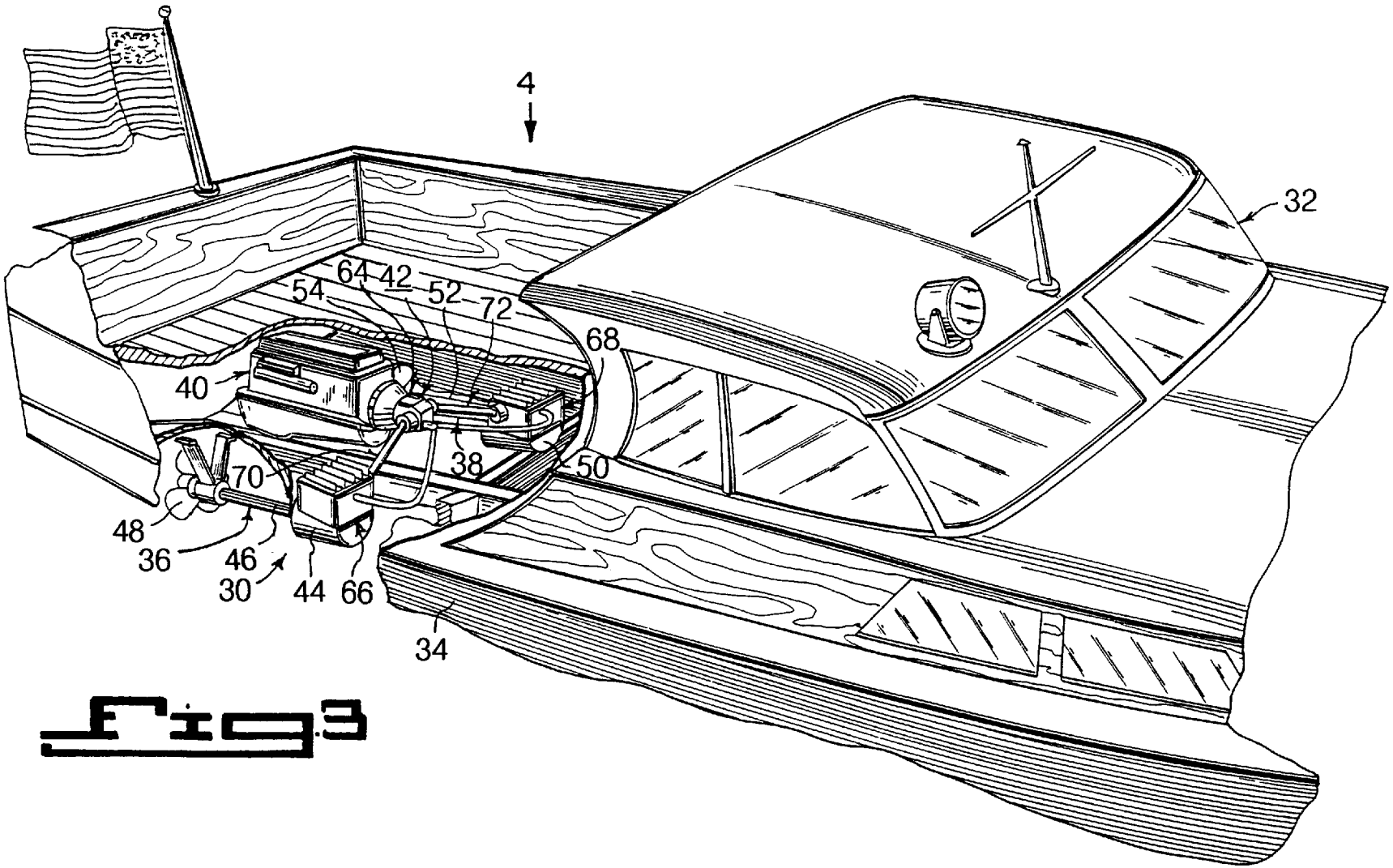
FIG. 3 is a perspective view of a marine vessel with parts broken away showing the propulsion system for a marine vessel of the present invention.
Figure 4:
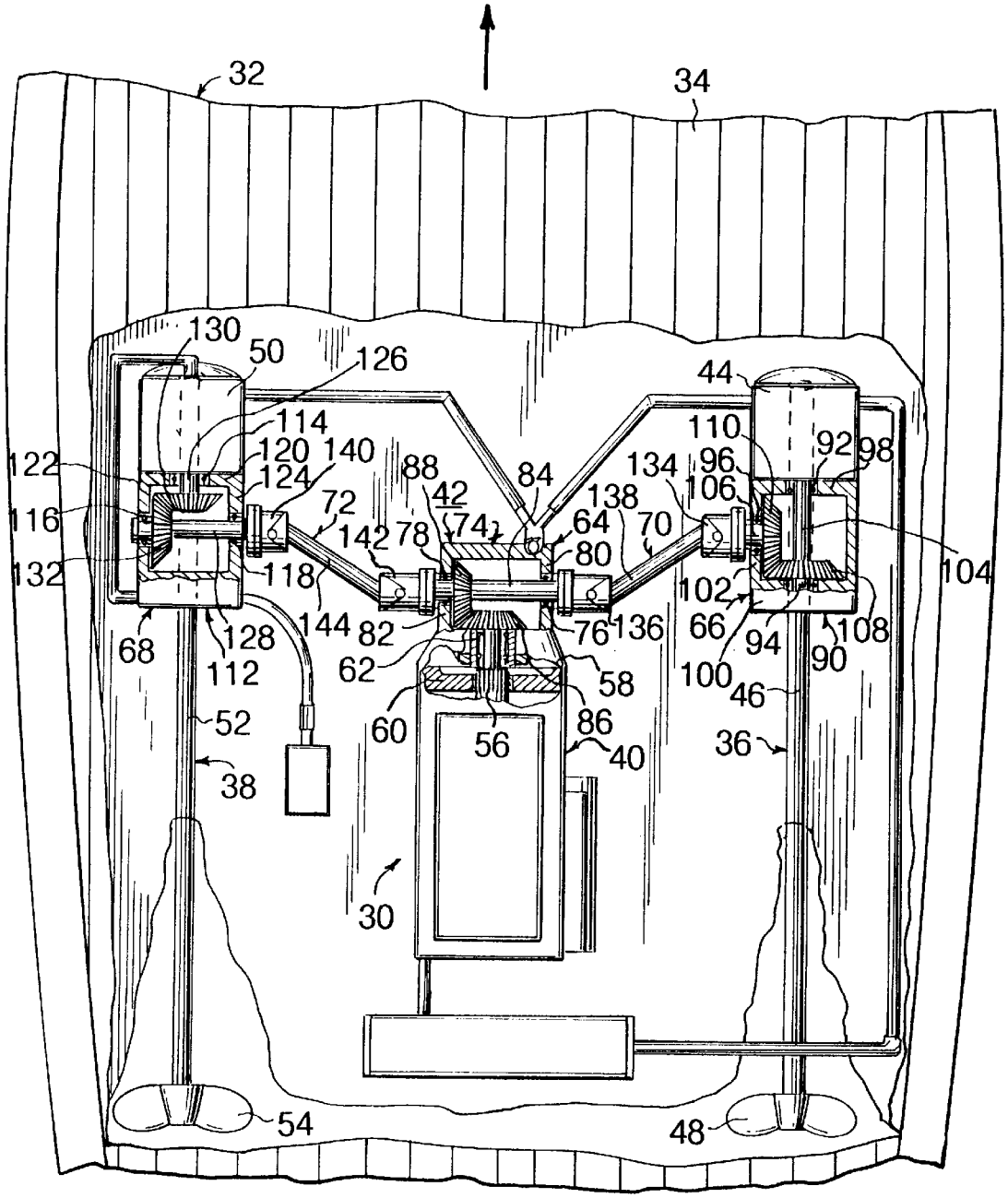
FIG. 4 is an enlarged top view of the marine vessel with parts broken away taken in the direction of arrow 4 in FIG. 3, showing the propulsion system for a marine vessel of the present invention.

Turning now descriptively to the drawings, in which similar reference characters denote similar elements throughout the several views, FIGS. 3 and 4 illustrate the propulsion system for a marine vessel of the present invention indicated generally by the numeral 30.

Figure 2:
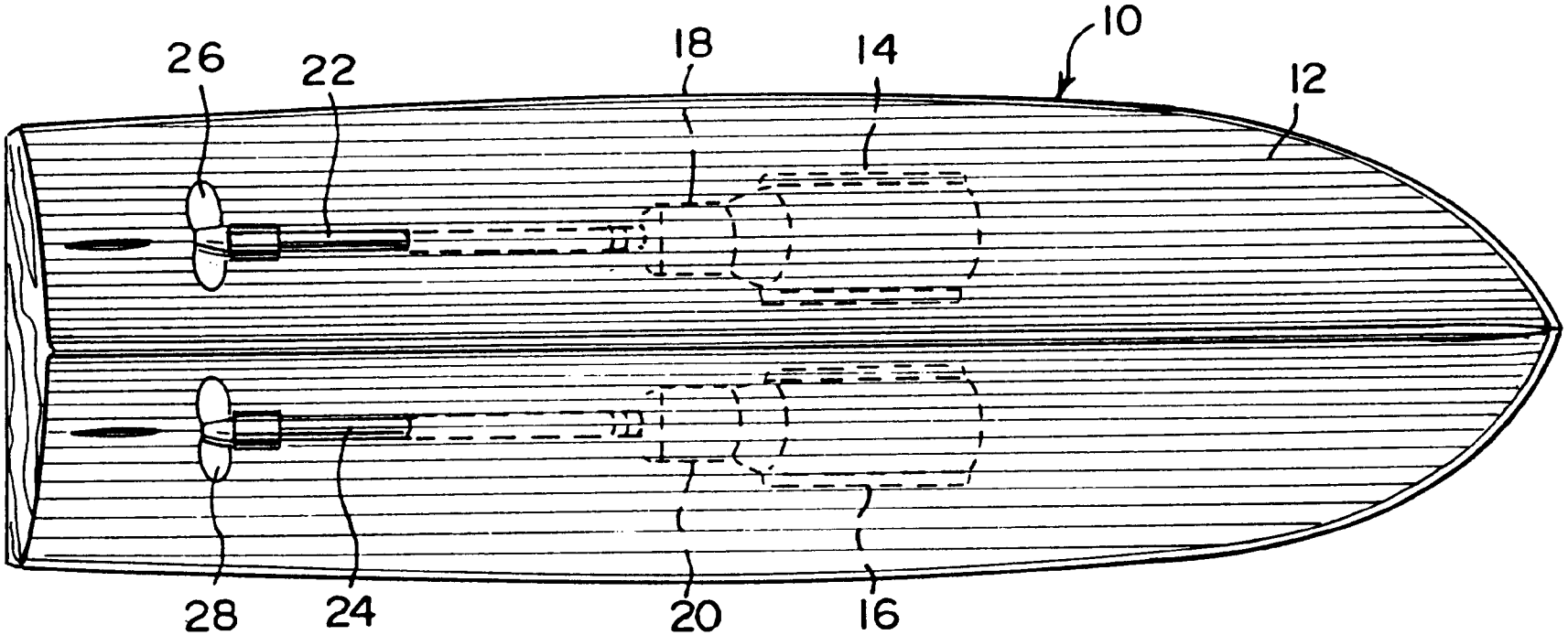
FIG. 2 (PRIOR ART)
FIG. 2 is a bottom view of the prior art nautical craft taken in the direction of arrow 2 in FIG. 2, the propulsion system of the craft shown in dotted lines.

A marine vessel 10 including a prior art propulsion system within a hull 12 thereof is illustrated in FIGS. 1 and 2. The prior art propulsion system includes a first engine 14 and a second engine 16 positioned within the hull 12. The first engine 14 is connected to drive a first transmission unit 18 and the second engine 16 is connected to drive a second transmission unit 20. A first propeller shafts 22 is connected at a first end to the first transmission unit 18 and extends from the hull 12. A second propeller shaft 28 is connected at a first end to the second transmission unit 20 and also extends from the hull 12. At a second end of the first propeller shaft 22 is a first propeller 26 and at a second end of the second propeller shaft 24 is a second propeller 28. The first transmission unit 18 rotates the first propeller shaft 22 and first propeller 26 and the second transmission unit 20 rotates the second propeller shaft 24 and second propeller 28 thereby powering the marine vessel. This propulsion system includes two engines, one engine for rotating each propeller. The need for first and second engines adds a large amount of weight to the hull of the vessel thus increasing the power needed to drive the vessel and the amount of fuel consumed by the vessel. The space needed for retaining the two engines within the hull is great and can be more efficiently used.

The propulsion system for a marine vessel 30 of the present invention is shown in FIGS. 3 and 4 positioned within a hull 34 of a marine vessel 32. The propulsion system 30 includes a first propeller assembly 36 and a second propeller assembly 38. The first propeller assembly 36 is mounted to extend through the hull 34 and along a starboard side of the marine vessel 32. The second propeller assembly 38 is mounted to extend through the hull 34 and along a port side of the marine vessel 32. A single engine 40 is mounted within the hull 34 along a keel of the vessel. The first and second propeller assemblies 36 and 38, respectively, are connected to the engine 40 by a connection device 42. The connection device 42 allows the engine 40 to simultaneously drive both the first and second propeller assemblies 36 and 38.

The first propeller assembly 36 includes a first transmission unit 44. A first propeller shaft 46 is rotatively connected at a first end to the first transmission unit 44 and a first propeller 48 is affixed to a second end of the first propeller shaft 46. The second end of the first propeller shaft 46 extends through and out of the hull 34 so that the first propeller 48 is positioned on an outer side of the vessel 32. The first transmission unit 44 rotates the first propeller shaft 46 and thus, the first propeller 48 to rotate in a clockwise direction.

The second propeller assembly 38 includes a second existing transmission unit 50. A second propeller shaft 52 is rotatively connected at a first end to the second transmission unit 50 and at a second end to a second propeller 54. The second end of the second propeller shaft 52 extends through and out of the hull 34 so that the second propeller 54 is positioned on an outer side of the vessel 32. The second transmission unit 50 rotates the second propeller shaft 52 and the second propeller 54 in a counterclockwise direction, opposing the rotation of the first propeller shaft 46 and first propeller 48.

The engine 40 is preferably provided within the hull 34 and positioned between the first and second propeller assemblies 36 and 38, respectively. The engine 40 includes a drive shaft 56 and a flywheel 60 attached thereto. A bearing 62 in an end wall 58 of the engine 40 secures the drive shaft 56 in position. The drive shaft 56 rotates about the bearing 62, when the single engine 40 is turned on and thereby rotates the flywheel 60 attached thereto.

The connection device 42 includes a primary gearbox 64 positioned at an end of the drive shaft 56. A first subordinate gearbox 66 is connected to the first transmission unit 44 and a second subordinate gearbox 68 is connected to the second transmission unit 50. The first subordinate gearbox 66 is connected to the primary gearbox 64 by a first connection structure 70. The second subordinate gearbox 68 is connected to the primary gearbox 64 by a second connection structure 72.

The primary gearbox 64 includes a casing 74 affixed onto the end wall 58 of the engine 40 and the drive shaft 56 extends into the primary gearbox 64. A first bearing 76 is mounted on a first side wall 80 of the casing 74 and a second bearing 78 is mounted to a second side wall 82 of the casing 74 opposing the first side wall 80. A primary shaft 84 is rotatively mounted within the casing 74 and extends through the first and second bearings 76, 78. The primary shaft 84 is transversely positioned with respect to the drive shaft 56. A first bevel 86 is connected to an end of the drive shaft 56 extending from the engine 40 and into the casing 74. A second bevel gear 88 is affixed onto the primary shaft 84 and meshes with the first bevel gear 86 whereby when the drive shaft 56 is rotates, the first bevel gear 86 is caused to rotate. Rotation of the first bevel gear 86 causes the second bevel gear 88 and the primary shaft 84 to also rotate due to the meshed relationship between the first and second bevel gears 86 and 88, respectively.

The first subordinate gearbox 66 includes a casing 90 positioned adjacent the first transmission unit 44. A first bearing 92 is provided to extend through a first wall 98 of the casing 90. A second bearing 94 is provided to extend through a second wall 100 of the casing 90. A third bearing 96 is provided to extend through a third wall 102 of the casing 90. The first and second bearings 92 and 94, respectively, are mounted to opposing walls 98 and 100, respectively, of the casing 90. The third bearing 96 is mounted to a wall 102 of the casing 90, facing the primary gearbox 64. A first subordinate shaft 104 is rotatively mounted to extend through the first and second bearings 92 and 94, respectively, and parallel to the first propeller shaft 46. The first subordinate shaft 104 connects with the first transmission unit 44. A second subordinate shaft 106 is rotatively mounted to extend through the third bearing 96 at a right angle to the first subordinate shaft 104. A first bevel gear 108 is affixed to the first subordinate shaft 104 and positioned within the casing 90. A second bevel gear 110 is affixed to the second subordinate shaft 106 and meshes with the first bevel gear 108 within the casing 90.

The second subordinate gearbox 68 includes a casing 112 positioned adjacent the second transmission unit 50. A first bearing 114 is provided to extend through a first wall 120 of the casing 112. A second bearing 116 is provided to extend through a second wall 122 of the casing 112. A third bearing 118 is provided to extend through a third wall 124 of the casing 112. The second and third bearings 116 and 118, respectively, are mounted to opposing walls 122 and 124, respectively, of the casing 112. The first bearing 114 is mounted to a wall 120 of the casing 112, facing the second propeller shaft 52. A first subordinate shaft 126 is rotatively mounted to extend through the first bearing 114 and extends parallel to the second propeller shaft 52. The first subordinate shaft 126 connects with the second transmission unit 44. A second subordinate shaft 128 extends through the second and third bearings 116 and 118, respectively, at a right angle to the first subordinate shaft 104 and faces the primary gearbox 64. A first bevel gear 130 is affixed to the first subordinate shaft 126 and positioned within the casing 112. A second bevel gear 132 is affixed to the second subordinate shaft 128 and meshes with the first bevel gear 126 within the casing 112.

The coupling device includes a first coupling structure 70 and a second coupling structure 72. The first coupling structure 70 connects the primary gearbox 64 to the first subordinate gear box 66 and the second coupling structure 72 connects the primary gearbox 64 to the second subordinate gearbox 68.

The first coupling structure includes a first ball and socket joint 134 and a second ball and socketjoint 136. The firstjoint 134 is connected to the second subordinated driven shaft 106 of the first subordinate gearbox 66. The second joint 136 is connected to a first end of the primary driven shaft 84 of the primary gearbox 64 and rotates with the primary shaft 84. A first cylindrical shank 138 extends between the first joint 134 and the second joint 136.

The second coupling structure 72 contains a first ball and socket joint 140 and a second ball and socket joint 142. The firstjoint 140 is connected to the second subordinate driven shaft 128 of the second subordinate gearbox 68. The second joint 142 is connected to a second end of the primary shaft 84 of the primary gearbox 64 and rotates with the primary shaft 84. A second cylindrical shank 144 extends between and connects the first joint 140 and the second joint 142.

The operation of the propulsion system for a marine vessel 10 will now be described with reference to the figures. In operation, the propulsion system for a marine vessel 10 is positioned within a marine vessel 10 with a single engine 40 positioned in the hull 12 and connected to first and second propeller assemblies 36 and 38, respectively. The first propeller assembly 36 extends outside the hull 34 along the starboard side of the vessel 32 and the second propeller assembly 38 extends outside of the hull 34 along the port side of the vessel 32. The first propeller assembly 36 is connected to the engine 40 via the primary gearbox 64 and first coupling structure 70. The second propeller assembly 38 is connected to the engine 40 via the primary gearbox 64 and second coupling structure 72.

When the engine 40 is turned on, the drive shaft 56 of the engine is caused to rotate. The drive shaft 56 extends through the end wall of the engine 40 and into the primary gearbox 64. As the drive shaft 56 rotates a first bevel gear 86 within the primary gearbox 64 and connected thereto is caused to rotate. A second bevel gear 88 within the primary gearbox 64 and in a meshed relationship with the first bevel gear 86 is caused to rotate. The second bevel is engaged with a primary shaft 84 causing the primary shaft 84 to rotate.

The primary shaft 84 is connected to both the first and second coupling structures 70 and 72, causing the first and second cylindrical shanks 138 and 144 to both rotate. The first cylindrical shank 138 is connected to the second subordinate shaft 106 of the first transmission unit 44 causing the second subordinate shaft 106 to rotate along with the second bevel gear 110 connected thereto. The bevel gear 110 causes the first bevel gear 108 in a meshed relationship therewith to rotate. The first bevel gear 108 is engaged with the transmission unit 44 for rotating the first propeller shaft 46 and the first propeller 48 therewith in a clockwise direction and providing a propulsion power to the vessel 32.

The second cylindrical shank 144 is connected to the second subordinate shaft 106 of the first transmission unit 44 causing the second subordinate shaft 128 to rotate along with the second bevel gear 132 connected thereto. The second bevel gear 132 causes the first bevel gear 130 in a meshed relationship therewith to rotate. The first bevel gear 132 is engaged with the second transmission unit 50 for rotating the second propeller shaft 52 and the second propeller 54 therewith in a counterclockwise direction providing additional propulsional power to the vessel 32. The clockwise rotation of the first propeller 48 and counterclockwise rotation of the second propeller 54 provide a propulsional force to the vessel 32. The rotation of the first and second propellers in opposing directions cause the vessel to be propelled along a straight line. Should the rotation of the drive shaft 54 be reversed, the first and second propellers will be caused to rotate in an opposite direction causing the vessel 32 to be move in reverse.

From the above description it can be seen that the propulsion system for a marine vessel of the present invention is able to overcome the shortcomings of prior art devices by providing a propulsion system for a marine vessel which includes a single engine mounted in the marine vessel for simultaneously driving two propeller assemblies thereby via a primary gear box driven. The propulsion system for a marine vessel eliminates the need for a second engine, thereby reducing the weight of the vessel whereby the vessel becomes more fuel efficient providing a tremendous saving to the owner of the marine vessel. Furthermore, the ladder including storage areas of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitution and changes in the forms and details of the device illustrated and in its operation can be made by those skilled in the art with out departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A system for propelling a marine vessel having a hull, said propulsion system comprising:

a) a first propeller assembly positioned to extend from the hull and along a starboard side of the vessel, said first propeller assembly including a first propeller positioned outside the hull said first propeller assembly including a first transmission unit connected to said first rotating unit; and a first propeller shaft rotatively connected at an inner end to said first transmission unit, wherein said first propeller is affixed to an end of said first propeller shaft opposite said first transmission unit;

b) a second propeller assembly positioned to extend from the hull and along a port side of the vessel, said second propeller assembly including a propeller positioned outside the hull;

c) an engine mounted within the hull; and d) means for rotating both said first and second propellers, said means for rotating including a first rotating unit connected between said engine and said first propeller assembly for driving said first transmission unit to rotate said first propeller and a second rotating unit connected between said engine and said second propeller assembly for rotating said second propeller; means for rotating including:

i) a primary gear box positioned on said end wall of said engine including a first bearing for receiving said drive shaft therethrough;

ii) a first bevel gear connected to rotate with said drive shaft and positioned within said gear box;

iii) a second bevel gear positioned perpendicular to and meshed to rotate with said first bevel gear; and iv) a primary shaft engaged to rotate with said second bevel gear to provide a rotational drive to said first and second rotating units, wherein said first rotating unit includes a first cylindrical shank connected to rotate with said primary shaft and said second rotating unit includes a second cylindrical shank connected to rotate with said primary shaft, and wherein, said first transmission unit includes a first subordinate shaft connected at one end to said first rotating unit, a first subordinate bevel gear connected to an end of said first subordinate shaft opposite said first rotating unit; a second subordinate shaft engaged with said first propulsion shaft; and a second subordinate bevel gear positioned perpendicular to and meshed to rotate with said first subordinate bevel gear causing said second subordinate shaft said first propeller shaft and said first propeller to rotate.

2. The propulsion system as recited in claim 1, wherein said second propeller assembly further includes:

a) a second transmission unit connected to said second rotating unit; and b) a second propeller shaft rotatively connected to said second transmission unit, wherein said first propeller is affixed to an end of said first propeller shaft opposite said first transmission unit, and said second transmission unit is driven by said second rotating unit for rotating said second propeller shaft and said second propeller.

3. The propulsion system for a marine vessel as recited in claim 1, wherein said second transmission unit includes:

a) a third subordinate shaft connected at one end to said second rotating unit;

b) a third subordinate bevel gear connected to an end of said second subordinate shaft opposite said second rotating unit;

c) a fourth subordinate shaft engaged with said second propulsion shaft; and d) a fourth subordinate bevel gear positioned perpendicular to and meshed to rotate with said third subordinate bevel gear causing said fourth subordinate shaft, said second propeller shaft and said second propeller to rotate.

4. The propulsion system for a marine vessel as recited in claim 1, wherein said second transmission means includes:

a) a third subordinate shaft connected at one end to said second rotating unit;

b) a third subordinate bevel gear connected to an end of said second subordinate shaft opposite said second rotating unit;

c) a fourth subordinate shaft engaged with said second propulsion shaft; and d) a fourth subordinate bevel gear positioned perpendicular to and meshed to rotate with said third subordinate bevel gear causing said fourth subordinate shaft, said second propeller shaft and said second propeller to rotate.

5. The propulsion system as recited in claim 4, wherein said first rotating unit includes:

a) a first ball and socket joint connecting said primary shaft to said first cylindrical shank; and b) a second ball and socket joint for connecting said first cylindrical shank to said first subordinate shaft.

6. The propulsion system as recited in claim 5, wherein said second rotating unit includes:

a) a third ball and socket joint connecting said primary shaft to said second cylindrical shank; and b) a fourth ball and socket joint for connecting said second cylindrical shank to said third subordinate shaft.

7. The propulsion system as recited in claim 1, wherein said first and second propellers are controlled to rotate in opposing directions.

* * * * *